US005465443A

United States Patent [19]

Rice et al.

[11] Patent Number: 5,465,443

[45] Date of Patent: Nov. 14, 1995

[54] SWIMMING POOL CLEANER DISCS AND ASSEMBLIES

[75] Inventors: Chris A. Rice, Boca Raton, Fla.; Alain J. Gazzola, Lyon, France; Desroy D. Smith, Ft. Lauderdale, Fla.; John T. Evans, Frenchs Forest; Andrew W. Dawson, Westleigh, both of Australia

[73] Assignee: Zarina Holdings C.V., Amsterdam, Netherlands

[21] Appl. No.: 334,749

[22] Filed: Nov. 4, 1994

Related U.S. Application Data

[63] Continuation-in-part of Ser. No. 185,451, Jan. 24, 1994, Pat. No. 5,418,995, which is a continuation-in-part of Ser. No. 103,930, Aug. 6, 1993, Pat. No. 5,421,054.

[51] Int. Cl.[6] ..... E04H 4/16

[52] U.S. Cl. ..... 15/246; 15/1.7

[58] Field of Search ..... 15/1.7, 246, 257.01

[56] References Cited

U.S. PATENT DOCUMENTS

| | | | |
|---|---|---|---|
| 2,215,377 | 9/1940 | Penfield et al. . | |
| 2,263,774 | 11/1941 | Heltzel et al. . | |
| 2,275,190 | 3/1942 | Lowry . | |
| 2,392,146 | 1/1946 | Hall . | |
| 2,809,387 | 10/1957 | Paiso . | |
| 3,902,215 | 9/1975 | Waldrop et al. . | |
| 4,095,378 | 6/1978 | Urakami | 15/1.7 |
| 4,152,802 | 5/1979 | Chauvier | 15/1.7 |
| 4,193,156 | 3/1980 | Chauvier | 15/1.7 |
| 4,193,469 | 3/1980 | Graf . | |
| 4,351,077 | 9/1982 | Hoffman | 15/1.7 |
| 4,530,125 | 7/1985 | Hoffman | 15/1.7 |
| 4,642,833 | 2/1987 | Stoltz et al. | 15/1.7 |
| 4,742,593 | 5/1988 | Kallenbach | 15/1.7 |
| 4,849,024 | 7/1989 | Supra | 15/1.7 |
| 4,852,211 | 8/1989 | Strausak | 15/1.7 |
| 4,949,419 | 8/1990 | Kallenbach | 15/1.7 |
| 4,979,986 | 12/1990 | Hill et al. | 366/317 |
| 5,014,382 | 5/1991 | Kallenbach | 15/1.7 |
| 5,198,156 | 3/1993 | Middleton et al. | 366/317 |

FOREIGN PATENT DOCUMENTS 2355353 5/1975 Germany .

OTHER PUBLICATIONS

Two photographs of a beige disc and bearing the handwritten notation "Jandy" (product shown available to Applicants prior to Nov. 4, 1994).

Two photographs of a blue disc and bearing the handwritten notation "Kreepy Krauley" (product shown available to Applicants prior to Nov. 4, 1994).

One photograph of a black disc and bearing the handwritten notation "Baracuda" (product shown available to Applicants prior to Nov. 4, 1994).

Two photographs of a blue disc for a swimming pool cleaner (product shown available to Applicants prior to Nov. 4, 1994).

*Primary Examiner*—Edward L. Roberts, Jr.

*Attorney, Agent, or Firm*—Dean W. Russell; Kilpatrick & Cody

[57] ABSTRACT

Discs and a footpad for devices such as automatic swimming pool cleaners are disclosed. The discs incorporate upwardly-extending, non-truncated fins protruding radially from their peripheries. The peripheries themselves, moreover, define a plurality of tongues for increased flexibility, and both the discs and footpad may include ramped segments facilitating movement over obstacles extending from swimming pool surfaces. Also disclosed are discs having series of slits spaced along portions of their peripheries. Each such disc may be part of an assembly including a "bib," or cap, that too may be slitted if desired. The slits of each component, when present, permit its effective surface area to increase as the associated cleaner climbs the side of a swimming pool, enhancing the maneuverability of the cleaner. By contrast, unslitted portions of the cap seal, or cover, the slits present in the disc to provide adequate suction for the disc against the pool surface.

10 Claims, 6 Drawing Sheets

SWIMMING POOL CLEANER DISCS AND ASSEMBLIES

CROSS-REFERENCE TO RELATED APPLICATIONS

This application is a continuation-in-part of (allowed) U.S. patent application Ser. No. 08/185,451, filed Jan. 24, 1994, now U.S. Pat. No. 5,418,995, entitled "Swimming Pool Cleaner Discs," which is a continuation-in-part of U.S. patent application Ser. No. 08/103,930, filed Aug. 6, 1993, now U.S. Pat. No. 5,421,054, entitled "Swimming Pool Cleaner Discs and Associated Equipment."

FIELD OF THE INVENTION

This invention relates to discs and associated equipment for cleaners of liquid-containing vessels and more particularly to automatic pool cleaners having finned or capped discs for improved maneuverability in swimming pools.

BACKGROUND OF THE INVENTION

U.S. Pat. Nos. 4,351,077 to Hofmann and 4,642,833 to Stoltz, et al., incorporated herein in their entireties by this reference, disclose automatic, water-interruption-type suction swimming pool cleaners having flexible annular discs. These discs are typically mounted near the inlets of the suction cleaners and designed to contact pool surfaces when in use. By doing so, the discs decrease the tendency of the cleaners to disengage from pool surfaces, particularly when the cleaners are negotiating transition regions between walls and floors.

U.S. Pat. No. 4,193,156 to Chauvier, also incorporated herein in its entirety by this reference, describes (at column 4, lines 5–55) an annular disc having numerous "concertina-like," "circumferentially spaced folds." These folds extend when their associated swimming pool cleaner encounters a transition region, purportedly "keeping the inflow of water into the mouth opening to a minimum." The underside of the disc is grooved, moreover, according to the Chauvier patent, to assist in removing dust from the floors and walls of swimming pools.

Other existing swimming pool cleaner discs, including one provided by Jandy Industries, Inc., contain upwardly-extending protrusions about their peripheries. The protrusions of the Jandy disc are truncated so that they do not extend beyond the disc's periphery, however, and the periphery itself is wholly circular. Another disc distributed outside the United States combines the upwardly-extending protrusions with a scalloped periphery. Again, however, the protrusions are truncated and thereby do not extend beyond the periphery of the disc. The vertical peripheral faces of the truncated protrusions of this disc function as stops, causing the disc to move around certain obstacles extending from internal pool surfaces rather than, for example, lodging under them or moving over them.

SUMMARY OF THE INVENTION

The present invention provides alternative flexible discs for devices such as automatic swimming pool cleaners. Unlike the discs described above, the present invention incorporates upwardly-extending, non-truncated fins protruding radially from the peripheries of the discs. The serpentine peripheries themselves, moreover, define a plurality of tongues, providing increased flexibility over even existing scalloped discs. Concurrently, the fins supply sufficient rigidity to the discs of the present invention to enable them to ride over various objects, including many drains, lights, valves, and nozzles, projecting from internal surfaces of pools.

Additional features of the present invention include a curved radius between the fins and the lower surface of the disc, providing a smooth transition therebetween. The disc underside also contains an integrally-formed ramped segment surrounding its (nominally circular) central aperture. This ramp assists the pool cleaner in negotiating obstacles, supplying a smooth progression from the disc bottom to the bottom of the cleaner footpad (which the disc surrounds in use), which too may include a ramp. Multiple openings through the disc enable fluid to pass from one surface of the disc to the other, maintaining a boundary fluid layer between the lower surface of the disc and the adjacent surface of the pool. These openings facilitate movement of the disc relative to the pool cleaner and allow dirt and debris to be entrained in the flow of fluid through the openings and in the boundary layer.

Another embodiment of the present invention includes a disc having a series of slits extending generally radially from the periphery of the disc to locations near the central aperture. These slits, present over the part of the periphery of the disc opposite the front of the cleaner, aid the cleaner in traversing the approximately 90° angles existing where one or more sides of a pool meet its bottom. In particular, as the cleaner starts to climb the side of a pool, adjacent portions of the disc divided by each slit begin to separate, increasing the effective surface area of the disc.

Placed atop the slitted portion of the disc may be a distinct "bib," or cap which if desired also may contain a series of slits. Each slit of the cap is positioned intermediate adjacent slits of the disc, sealing those slits sufficiently to provide adequate suction when the cleaner encounters complex geometries within a swimming pool. Like those of the disc, however, the slits (when present) in the cap permit it effectively to expand and conform to the pool bottom as the cleaner commences climbing the sides of the pool.

It is therefore an object of the present invention to provide a disc incorporating upwardly-extending, non-truncated fins protruding beyond its periphery.

It is another object of the present invention to provide a disc having a serpentine periphery forming a plurality of tongues for increased flexibility.

It is a further object of the present invention to provide a disc facilitating movement of an automatic swimming pool cleaner over various objects projecting from internal surfaces of pools.

It is an additional object of the present invention to provide a disc having a curved radius between fins and its lower surface.

It is yet another object of the present invention to provide a disc having an underside containing a ramped segment surrounding its central aperture.

It is, moreover, an object of the present invention to provide a disc including multiple openings therethrough, enabling fluid to pass from one surface of the disc to the other.

It is a further object of the present invention to provide a disc having slits extending generally radially from at least portions of its periphery.

It is another object of the present invention to provide an assembly including a "bib," or cap that too may be slitted, with the slits of the cap positioned intermediate those of the disc.

Other objects, features, and advantages of the present invention will become apparent with reference to the remainder of the text and the drawings of this application.

DETAILED DESCRIPTION

Figure 1:
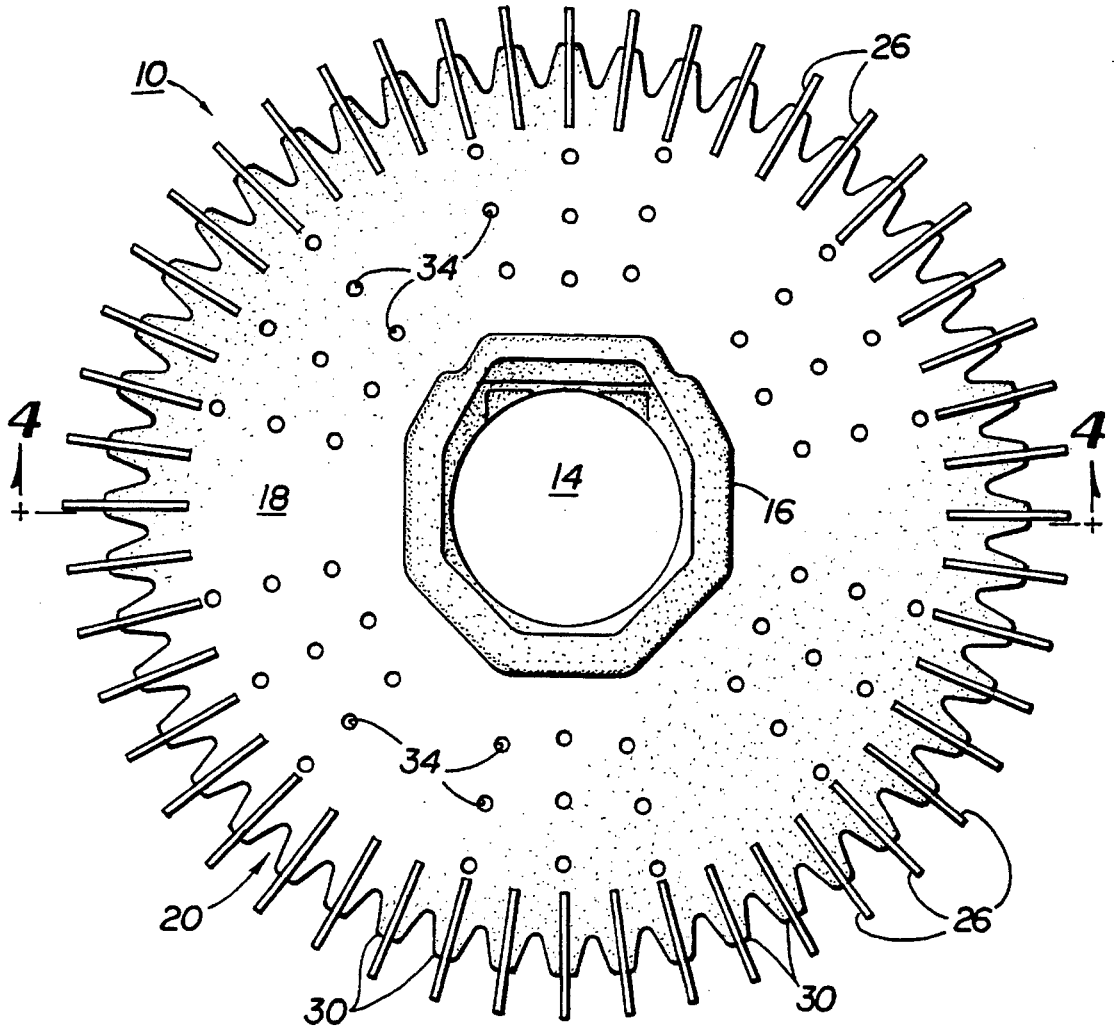
FIG. 1 is a top plan view of a disc (and footpad) of the present invention.
Figure 2:
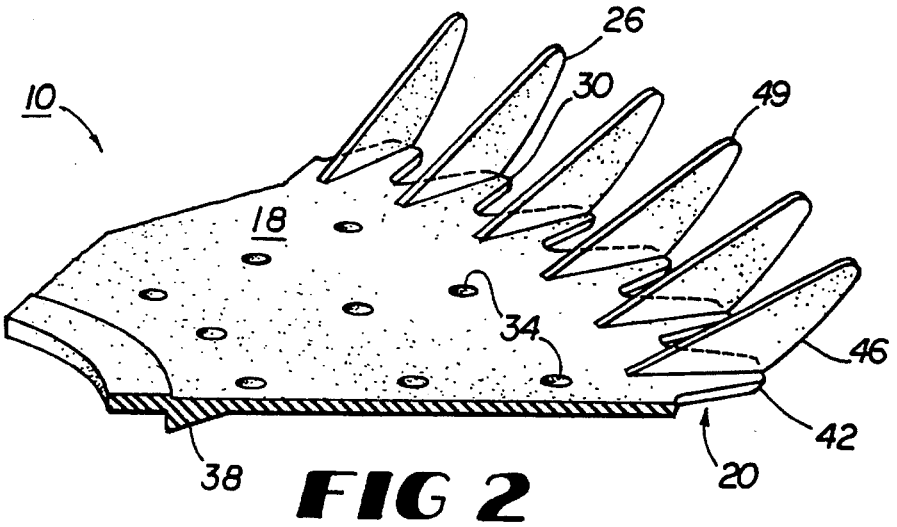
FIG. 2 is a perspective view of a portion of the disc of FIG. 1.
Figure 3:
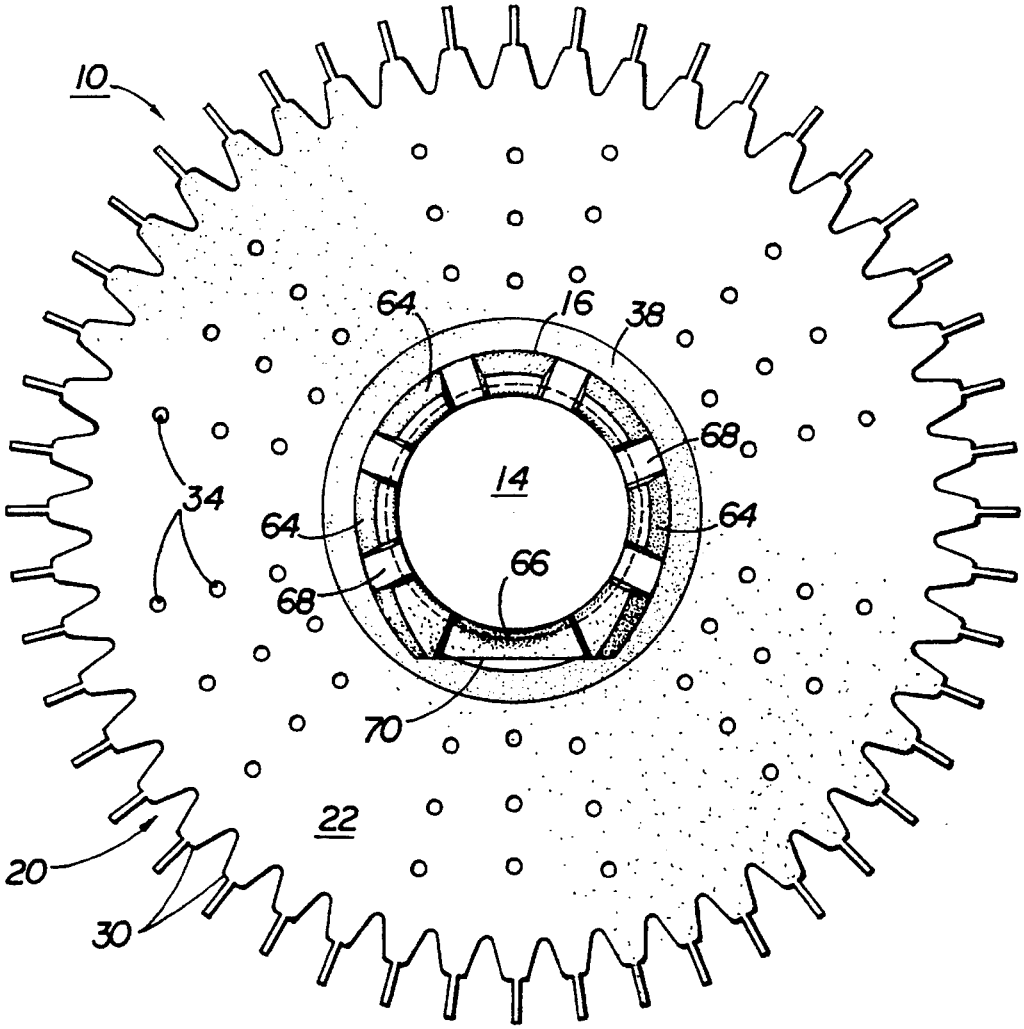
FIG. 3 is a bottom plan view of the disc and footpad of FIG. 1.

FIGS. 1–4 illustrate disc 10 of the present invention. Disc 10 defines a central aperture 14, nominally circular, in which a footpad 16 of an automatic swimming pool cleaner may be received, for example. Disc 10 also defines a generally planar upper surface 18, a periphery 20 and, as shown in FIG. 3, a lower surface 22. Extending upward from and spaced about upper surface 18 are fins 26, which assist disc 10 in maneuvering over many objects (such as drains, lights, valves, and nozzles) projecting from internal surfaces of pools. Fins 26 additionally extend beyond periphery 20, causing them to contact most projections before the remainder of disc 10.

FIGS. 1–3 also detail the serpentine nature of periphery 20. The shape of periphery 20 defines multiple tongues 30, increasing the flexibility of disc 10 and on which an equivalent number of fins 26 are positioned. Although forty-eight tongues are shown in FIG. 1, such number of tongues (and fins) is not required and may vary as necessary or desired. Openings 34 through disc 10 enable fluid to pass between upper and lower surfaces 18 and 22 of disc 10 when in use, maintaining a boundary fluid layer between the lower surface 22 of disc 10 and the adjacent surface of the pool or other structure to be cleaned.

Figure 4:
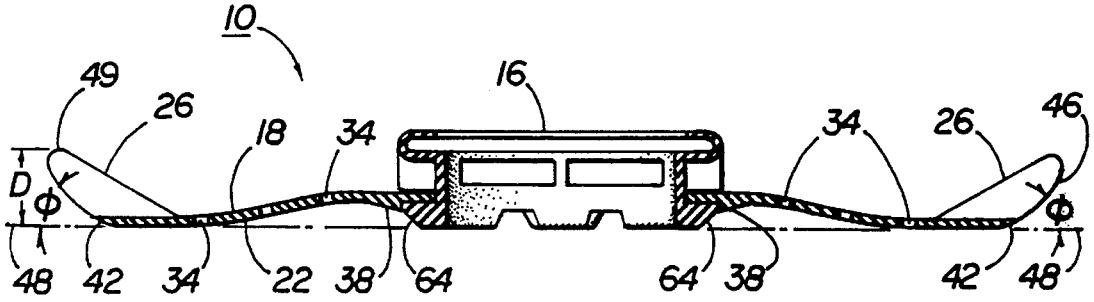
FIG. 4 is a cross-sectional view of the disc and footpad of FIG. 1 taken along lines 4—4 of that figure.

Shown in FIGS. 2–4 is ramp 38, projecting from lower surface 22 of disc 10 and positioned concentrically about central aperture 14. Ramp 38 promotes a smooth transition between lower surface 22 and the bottom of footpad 16 (or other component) received by central aperture 14, facilitating unobstructed movement of a swimming pool cleaner associated with the footpad 16. FIGS. 2 and 4 similarly disclose radius 42 existing between fins 26 and lower surface 22 of disc 10, providing a smooth transition therebetween.

In an embodiment of the invention consistent with FIGS. 1–4, fins 26 are spaced approximately every 7.5° about periphery 20. This spacing of fins 26 precludes sufficiently small-diameter objects from becoming entangled between adjacent fins 26 as an associated swimming pool cleaner moves about the surfaces of a pool. Instead, fins 26, including radii 42 and the remainders of their curved leading edges 46, are designed to ride over the objects, thereby carrying the associated swimming pool cleaner over the obstacles as well. Evenly spacing fins 26 about periphery 20 and having them extend radially from periphery 20 cause disc 10 to be more flexible than, for example, having the entirety of its periphery 20 raised (like a dinner plate). Fins 26 additionally assist in bending disc 10 to remain in contact with vertical or angled walls extending from the bottom surface of the swimming pool.

FIG. 4 details various angular and distance relationships between a fin 26 and disc 10. As shown in FIG. 4, leading edge 46 of fin 26 forms an angle "$\phi$" with axis 48, an extension of a radius of lower surface 22, while "D" describes the distance between the uppermost portion 49 of fin 26 and axis 48. In at least one embodiment of the invention, $\phi$ is approximately 45° and D equals 1.06 inches. Fins 46 may be made of plastic or other flexible material and integrally molded with disc 10, facilitating uniformity of these angular and distance relationships between fins 26 of a disc 10 and between discs 10 themselves. In some embodiments, disc 10 has an approximate diameter of fourteen inches measured from the center of central aperture 14 to the outermost extension of fins 46.

Figure 5:
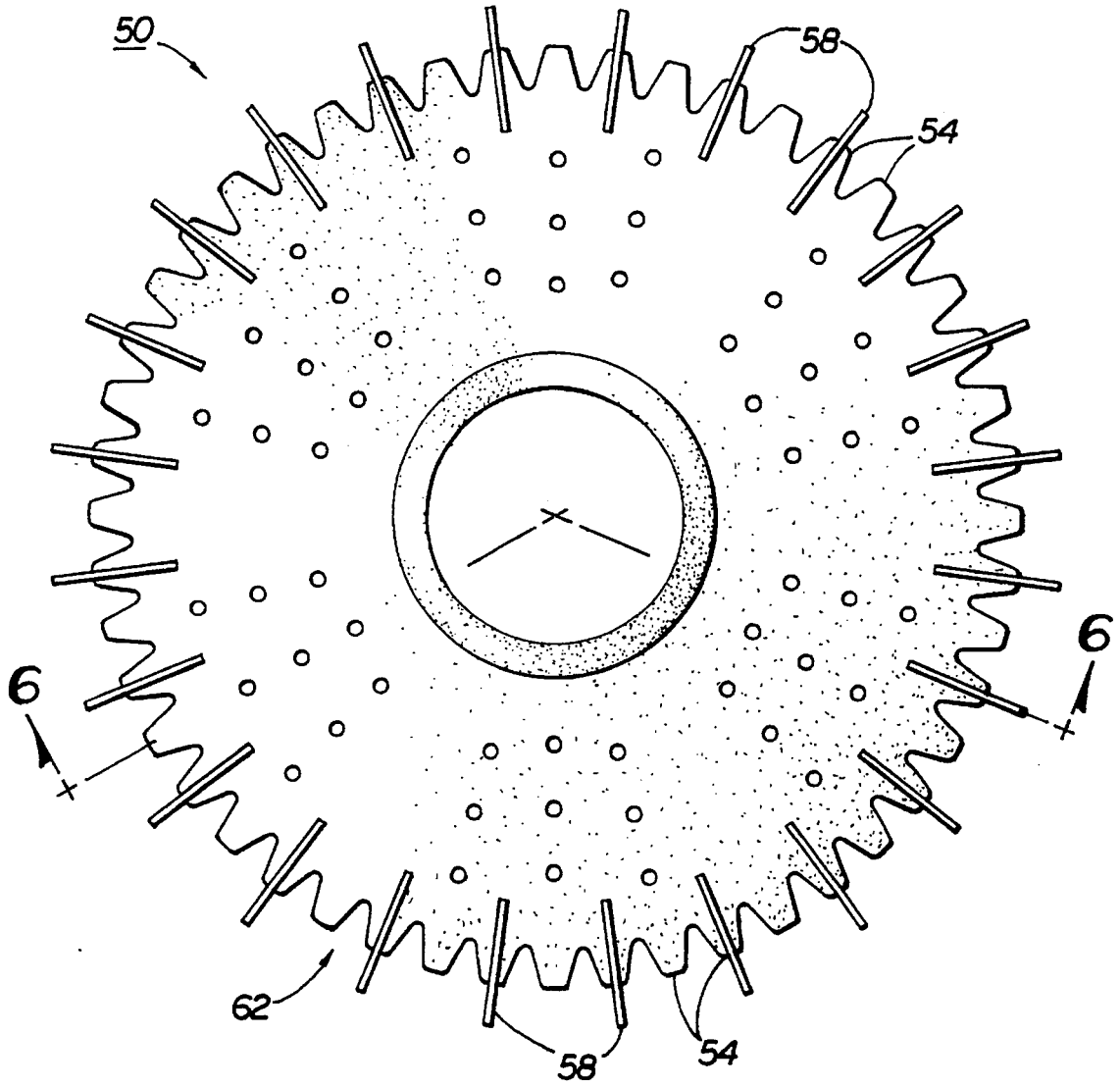
FIG. 5 is a top plan view of an alternate disc of the present invention.
Figure 6:
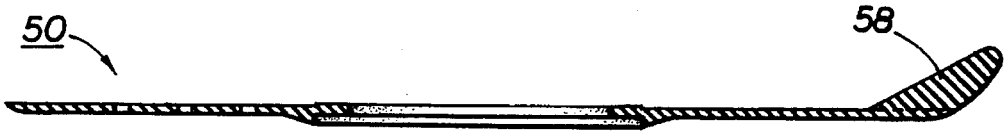
FIG. 6 is a cross-sectional view of the disc of FIG. 5 taken along lines 6—6 of that figure.

FIGS. 5–6 illustrate an alternate disc 50 of the present invention. Although including tongues 54 and fins 58 similar to disc 10, the number of each is not identical. Rather, twice as many tongues 54 as fins 58 are present for disc 50. Consequently, fins 58 are positioned (at approximately 15° intervals) about the periphery 62 of disc 50 on alternating tongues 54. The increased spacing between fins 58 permits larger leaves and other debris to pass between them to the inlet of the swimming pool cleaner to which disc 50 may be attached in use. At the same time, tongues 54 lacking associated fins 58 remain sufficiently flexible so that they bend when encountering obstacles, enabling the adjacent fins 58 and tongues 54 to continue passing over the obstacles.

Although discs 10 and 50 can be attached to existing footpads, footpad 16 shown in FIGS. 1, 3, and 4 provides an alternative device for connecting a disc to an automatic swimming pool cleaner. Like ramp 38 of lower surface 22, the outer surfaces 64 of footpad 16 are sloped to continue the smooth transition from lower surface 22 to the mouth of an automatic swimming pool cleaner. Rear interior surface 66 is similarly ramped or sloped to facilitate dislodging a swimming pool cleaner from small diameter obstacles extending from the pool surface. Footpad 16 additionally includes slots 68 and 70 through which water and entrained debris may flow. As illustrated in FIGS. 3 and 4, slots 68 are spaced approximately 45° about footpad 16, with larger slot 70 occupying the rear of the footpad 16.

Figure 7:
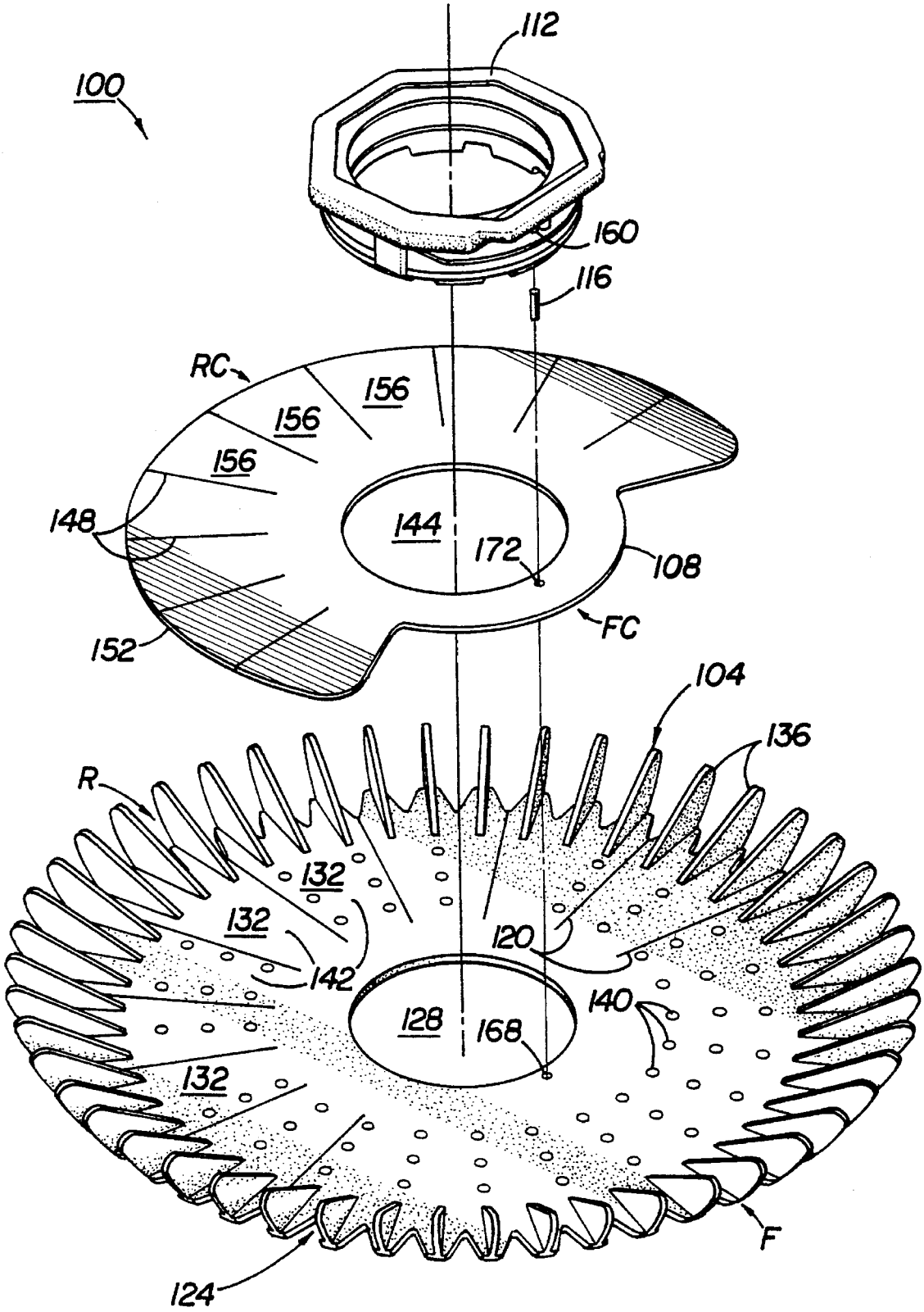
FIG. 7 is an exploded perspective view of another disc assembly (with footpad) of the present invention.
Figure 8:
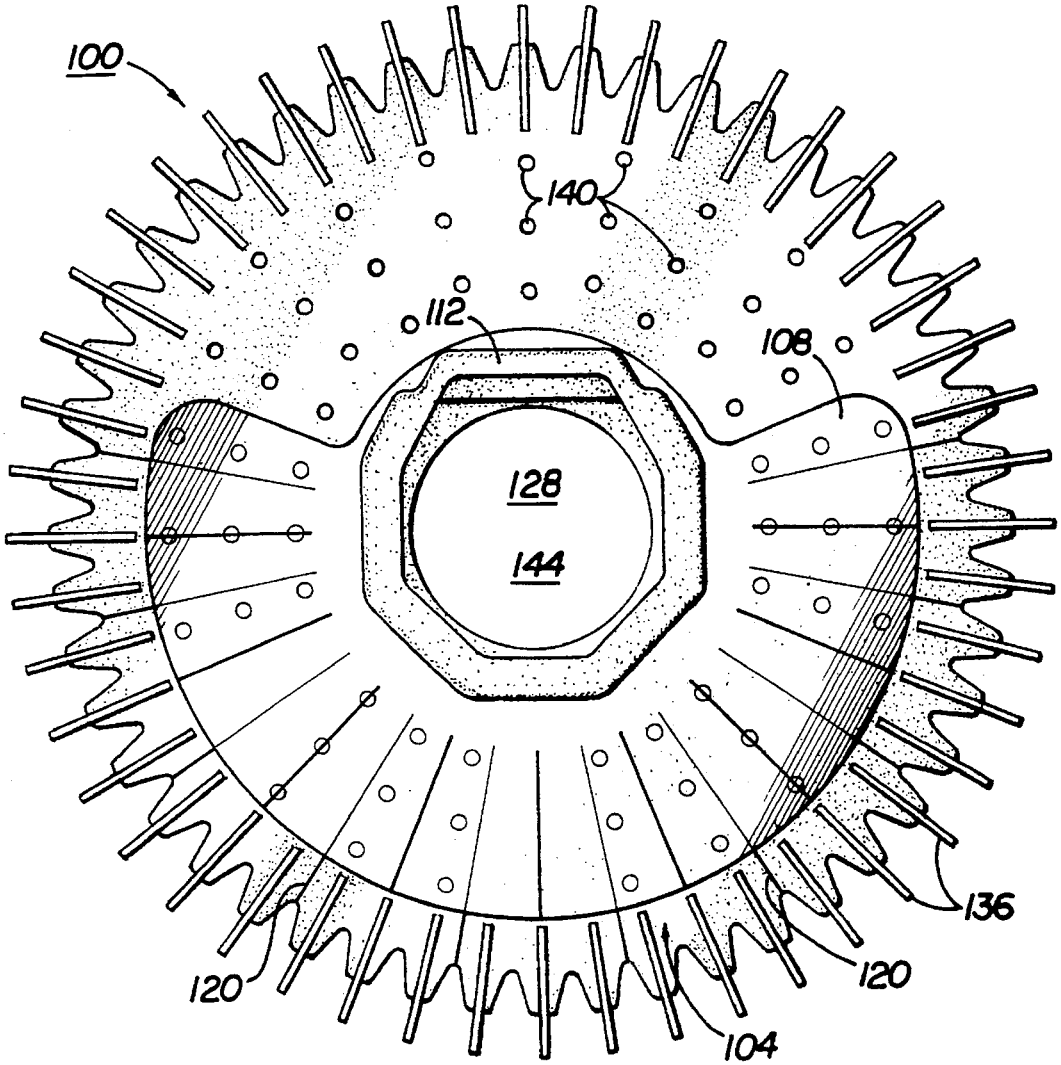
FIG. 8 is a top plan view of the disc assembly of FIG. 7.
Figure 9:
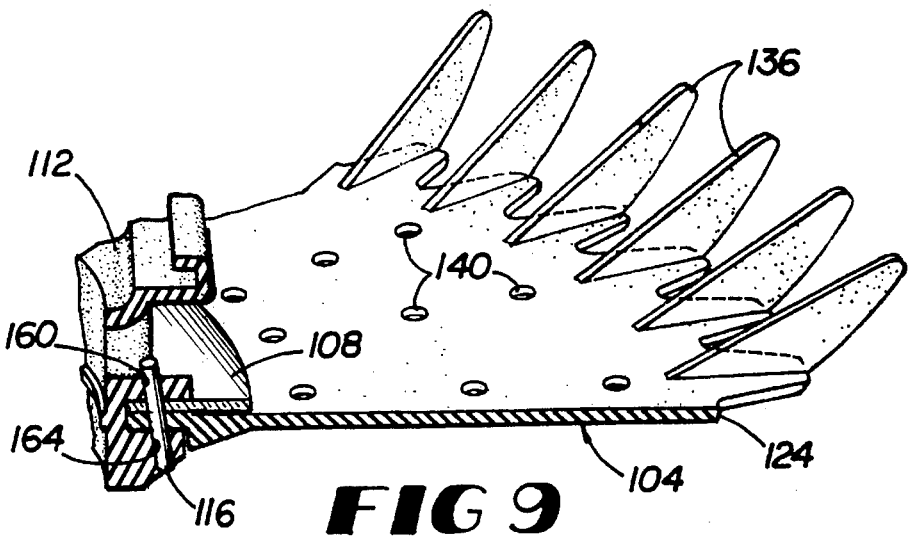
FIG. 9 is a cross-sectional view of a portion of the disc assembly of FIG. 7.

Shown in FIGS. 7–9 is an alternate assembly 100 of the present invention. Assembly 100 includes disc 104 and "bib" or cap 108. Also illustrated in FIGS. 7–9 are footpad 112 and pin 116, each of which may be included as part of assembly 100 as necessary or desired.

Disc 104, nominally having front section F and rear section R corresponding to front and rear portions of an associated pool cleaner, includes in rear section R a series of spaced slits 120 extending generally radially from its periphery 124 toward central aperture 128. Slits 120 aid the associated cleaner in traversing the approximately 90° angles existing where one or more sides of a pool meet its bottom. As the cleaner begins climbing the side of a pool, adjacent portions 132 of disc 104 divided by each slit 120 begin to separate, increasing the effective surface area of the disc 104. Disc 104 additionally may include fins 136 spaced about periphery 124, as well as openings 140.

Positioned atop upper surface 142 of rear section R of disc 104 is cap 108. Cap 108 includes an aperture 144 aligned with central aperture 128, both of which apertures comprise means for receiving footpad 112. Slits 148 extend from the periphery 152 of rear section RC of cap 108 inward toward aperture 144, dividing the rear section RC into adjacent sections 156. Front section FC, by contrast, is not so divided. Like slits 120, slits 148 serve to permit cap 108 effectively to expand and conform to the pool bottom as the cleaner commences climbing the side of the pool.

As best illustrated in FIG. 8, slits 120 and 148 are not aligned. Instead, slits 148 are positioned intermediate slits 120, permitting sections 156 to overlap, or cover, slits 120 and seal them sufficiently to provide adequate suction when the cleaner encounters complex geometries within a swimming pool. Because cap 108 (typically made of plastic) is not adhered to upper surface 142, however, it does not prevent separation of adjacent portions 132 of disc 104 as the cleaner climbs the side of a pool.

Disc 104 and cap 108 are not intended to rotate significantly about footpad 112. As a result, pin 116 may be used to fix the relative positions of disc 104 and cap 108 vis-a-vis footpad 112. As detailed in FIGS. 7 and 9, pin 116 may be inserted through openings 160 and 164 of footpad 112 and openings 168 and 172 of, respectively, disc 104 and cap 108. Footpad 112, alternatively, may include stops or other means for preventing disc 104 and cap 108 from rotating more than a desired amount (e.g. 30°, comprising ±15° from a nominal position in which disc 104 may receive footpad 112).

Figure 10:
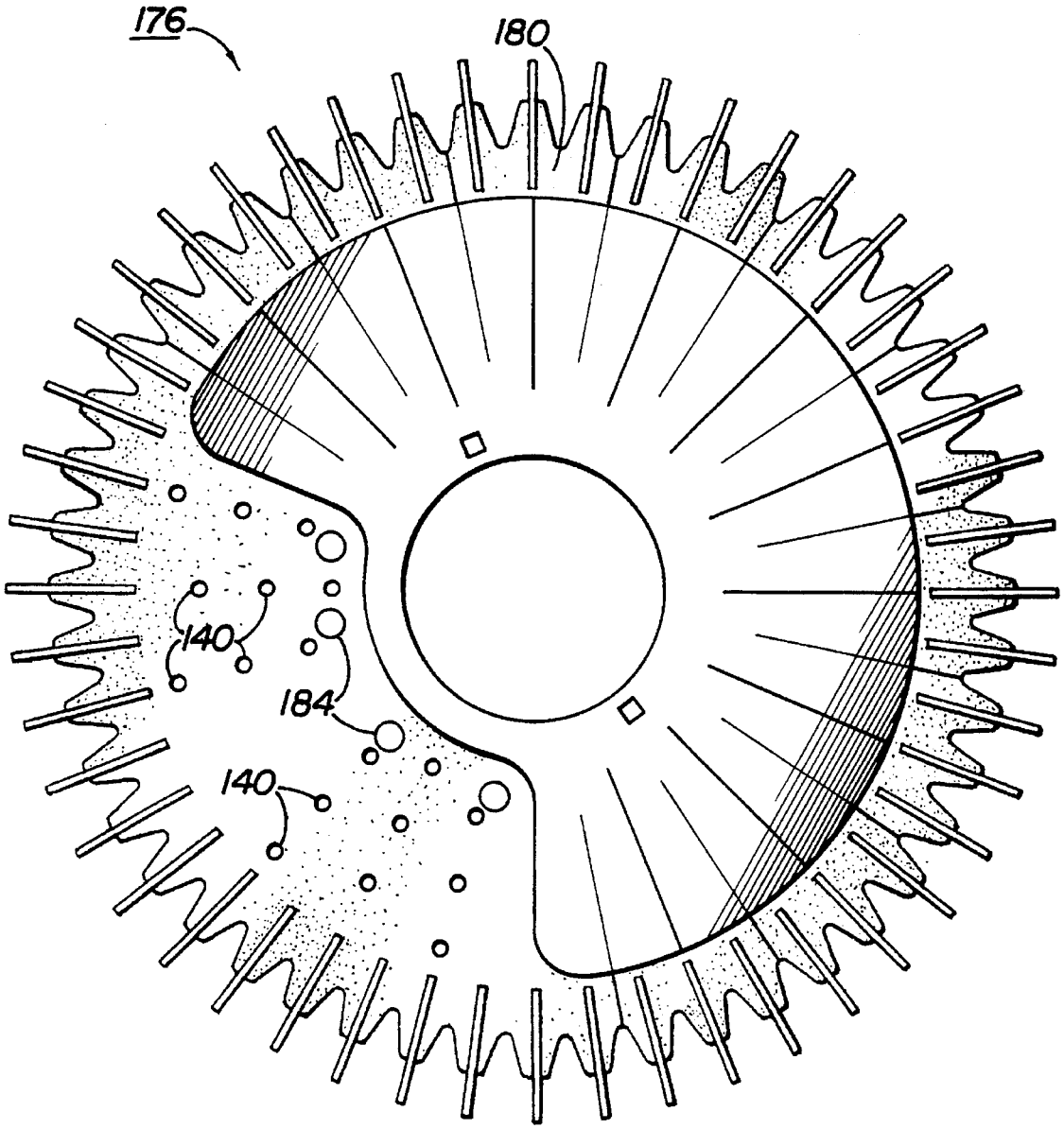
FIG. 10 is a top plan view of yet another disc assembly of the present invention.

FIG. 10 illustrates an alternative assembly 176 of the present invention. Although similar in many respects to assembly 100, assembly 176 includes disc 180 having openings 140 solely in front section F. Openings 140 (together with enlarged openings 184 when present) reduce the adhesive force to which front section F of disc 180 is subjected in use, diminishing the likelihood that disc 180 could prevent its associated cleaner from climbing the side of a pool. By contrast, omitting openings 140 from rear section R of disc 180 enhances the adhesive force present there, reducing the likelihood that the cleaner would slide down the side between forward movements.

The foregoing is provided for purposes of illustrating, explaining, and describing embodiments of the present invention. Modifications and adaptations to these embodiments will be apparent to those of ordinary skill in the art and may be made without departing from the scope or spirit of the invention.

What is claimed is:

1. A disc adapted for use as part of an automatic swimming pool cleaner, comprising:

a. an upper surface;

b. a lower surface;

c. a periphery;

d. a plurality of fins integrally formed with and extending upward from the upper surface beyond the periphery;

e. means, comprising a central aperture, for receiving a portion of the automatic swimming pool cleaner; and f. a plurality of slits extending from at least a portion of the periphery toward, but not to, the central aperture.

2. A disc according to claim 1 further comprising a plurality of openings through which fluid may pass from the lower surface to the upper surface when the automatic swimming pool cleaner is immersed in the fluid.

3. An assembly adapted to receive a footpad of an automatic swimming pool cleaner, comprising:

a. a disc having a central aperture for receiving the footpad and comprising:

i. an upper surface;

ii. a lower surface;

iii. a periphery; and iv. a plurality of slits extending from at least a portion of the periphery toward, but not to, the central aperture; and b. means, distinct from the disc, for covering the slits.

4. An assembly according to claim 3 in which the covering means comprises a cap defining an aperture.

5. An assembly according to claim 4 in which the cap includes a periphery and a plurality of slits extending from at least a portion of the periphery toward, but not to, the aperture.

6. An assembly according to claim 5 in which the cap contacts a portion of the upper surface, the remainder of the upper surface defining a plurality of openings to the bottom surface.

7. An assembly according to claim 6 further comprising means for restraining rotation of the cap relative to the disc when in use.

8. An assembly according to claim 7 in which the rotation restraining means comprises a stop connected to the footpad, which stop precludes the disc from rotating more than approximately ±15° relative to a nominal position in which it receives the footpad.

9. An assembly according to claim 8 in which the disc further comprises a plurality of fins integrally formed with and extending upward from the upper surface beyond the periphery.

10. An assembly adapted to receive a footpad of an automatic swimming pool cleaner, comprising:

a. a molded plastic, flexible disc having a central aperture and comprising:

i. a planar upper surface;

ii. a lower surface defining (1) a plurality of openings to the upper surface through which fluid may pass when the automatic swimming pool cleaner is immersed in the fluid and (2) an axis along a selected radius;

iii. a periphery defining a plurality of radially-spaced tongues;

iv. a plurality of fins extending upward from the upper surface beyond the periphery, each fin (1) having a leading edge defining an angle of approximately 45° with the axis and (2) being integrally formed with a tongue of the plurality of radially-spaced tongues;

v. a plurality of slits extending radially from at least a portion of the periphery toward, but not to, the central aperture; and vi. an annular ramp integrally formed with the lower surface and concentric with the central aperture;

b. a cap placed atop the upper surface of the disc and comprising:

i. an aperture aligned with the central aperture of the disc;

ii. a periphery; and iii. a plurality of slits extending from at least a portion of the periphery toward, but not to, the aperture, which slits are not aligned with the slits of the disc; and c. means for preventing the disc and cap from rotating unrestrained about the footpad.

* * * * *